US007448888B2

(12) United States Patent
Okano

(10) Patent No.: US 7,448,888 B2
(45) Date of Patent: Nov. 11, 2008

(54) CONNECTOR AND A CONNECTOR ASSEMBLY

(75) Inventor: Tomoki Okano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/935,579

(22) Filed: Nov. 6, 2007

(65) Prior Publication Data

US 2008/0119074 A1 May 22, 2008

(51) Int. Cl.
*H01R 13/62* (2006.01)

(52) U.S. Cl. ..... 439/157

(58) Field of Classification Search ..... 439/157, 439/347, 160, 159

See application file for complete search history.

(56) References Cited

U.S. PATENT DOCUMENTS 6,644,992 B2 * 11/2003 Maegawa ..... 439/157
6,863,463 B2 * 3/2005 Matsushita ..... 403/322.4
7,090,518 B1 * 8/2006 Osada et al. ..... 439/157
7,210,948 B2 * 5/2007 Nishide ..... 439/157
2005/0059280 A1 3/2005 Hobbs et al.
2006/0154505 A1 7/2006 Nishide

FOREIGN PATENT DOCUMENTS

FR 2 803 111 6/2001

* cited by examiner

*Primary Examiner*—Jean F Duverne
(74) *Attorney, Agent, or Firm*—Gerald E. Hespos; Anthony J. Casella

(57) ABSTRACT

A male terminal protection plate (30) is moved together with a female housing (50) in a direction separating from a receptacle (12), any further movement of the male terminal protection plate (30) in the separating direction can be prevented when a pair of locking projections (37) come into engagement with the upper edges of a pair of engaging grooves (18). Since the pair of locking projections (37) and the pair of engaging grooves (18) are arranged at the opposite sides of a cam pin (34), about which the male terminal protection plate (30) could be inclined, in a direction normal to moving directions of the male terminal protection plate (30), the inclination of the male terminal protection plate (30) can be prevented.

10 Claims, 9 Drawing Sheets

CONNECTOR AND A CONNECTOR ASSEMBLY

BACKGROUND OF THE INVENTION

1. Field of the Invention

The invention relates to a connector with a male terminal protection plate.

2. Description of the Related Art

U.S. Patent Application Publication No. 2006/0154505 discloses a connector with a male terminal protection plate. The male terminal protection plate has a surrounding wall accommodated in a receptacle of a male housing and tabs of male terminal fittings are positioned by the male terminal protection plate. A lever is mounted on the male housing and is formed with cam grooves. Cam pins project from the surrounding wall of the male terminal protection plate and can be united with cam followers of the mating female housing. The cam pins and the cam followers can be received in the cam grooves of the lever. The lever then is rotated to pull the female housing and the male terminal protection plate into the receptacle for connecting the male and female housings.

A connector with a male terminal protection plate generally provides a clearance between the inner peripheral surface of the receptacle and the outer peripheral surface of the surrounding wall of the male terminal protection plate to improve operability upon mounting the male terminal protection plate into the receptacle. Thus, the male terminal protection plate can incline like a seesaw in the receptacle with the cam pins as supporting points.

The male terminal protection plate might incline together with the female housing upon separating the female housing from the male housing, and the female housing might interfere with the receptacle to hinder the separating operation due to this inclination.

The invention was developed in view of the above situation, and an object thereof is to prevent inclination of a male terminal protection plate in a receptacle, and hence to improve the overall operability of a connector.

SUMMARY OF THE INVENTION

The invention relates to a connector with a terminal protection plate that includes a positioning plate for positioning at least one terminal fitting and at least one wall at or near the peripheral edge of the positioning plate. The terminal protection plate is accommodated in a receptacle of a housing and is movable substantially in separating and connecting directions of the housing with a mating housing. An operable member is mounted movably to the housing and is formed with at least one cam groove. The terminal protection plate is formed with at least one cam pin that can be united with a cam follower of the mating housing. The united cam pin and cam follower are engageable with the cam groove of the operable member. The mating housing and the terminal protection plate can be displaced with respect to the receptacle by operating the operable member. One or more engaging grooves plate are formed on the inner periphery of the receptacle and extend substantially in moving directions of the terminal protection. The engaging grooves are adjacent to the cam pin in a direction at an angle to the moving directions of the terminal protection plate. One or more locking projections project out from the outer peripheral surface of the wall and are engageable with the respective engaging grooves. One or more stoppers are formed near the front end edges of the engaging grooves. The stoppers engage the locking projections for preventing the separation of the terminal protection plate from the receptacle.

The terminal protection plate can be moved together with the female housing in a direction for separating from the receptacle. However, any further movement of the terminal protection plate in the separating direction is prevented when the locking projections engage with the engaging grooves.

The engagement of the locking projections and the engaging grooves prevents inclination of the terminal protection plate in the process of moving the terminal protection plate in the receptacle. Thus, the terminal protection plate and the housing can be moved smoothly in the connecting and separating directions without causing any wrenching movement.

Two engaging grooves preferably are formed on the inner periphery of the receptacle at substantially opposite sides of the cam pin in directions substantially normal to the moving directions of the terminal protection plate. The engaging grooves preferably extend substantially in moving directions of the terminal protection plate.

Two locking projections preferably project out from the outer peripheral surface of the wall of the terminal protection plate and are engageable with the engaging grooves. Stoppers are formed near the front ends of the engaging grooves and engage the locking projections to prevent separation of the terminal protection plate from the receptacle.

The locking projections engage the front end edges of the engaging grooves to limit movement of the male terminal protection plate in the separating direction. Additionally, the two locking projections and the two engaging grooves are arranged at opposite sides of the cam pin in directions normal to the moving directions of the male terminal protection plate. Thus, the male terminal protection plate cannot incline about the cam pins. Accordingly, the female housing will not interfere with the receptacle due to the inclination of the male terminal protection plate, and the female housing can be separated efficiently from the receptacle. Further, the male terminal protection plate and the female housing can be moved smoothly in the connecting and separating directions without causing any wrenching movement.

The one or more locking projections preferably are formed on one or more resilient locking pieces displaceable inward relative to the wall. Thus, the resilient locking pieces are deformed resiliently inward upon mounting the male terminal protection plate into the receptacle. As a result, the locking projections can pass the stoppers to engage with the engaging grooves, and assembling operability can be improved.

The resilient locking pieces preferably are cantilevered in the separating direction of the mating housing from the receptacle. Additionally, the extending ends of the locking projections preferably are exposed at the front edge of the wall. Thus, an opening direction of a mold for forming the resilient locking pieces can be the same as the direction from the rear end toward the front end of the surrounding wall, i.e. an opening direction of a mold for forming the surrounding wall. A mold that is opened in a normal to the surface of the surrounding wall can be eliminated and a cost for molds can be reduced.

The supporting points of the resilient locking pieces are not at the front end edge of the surrounding wall. Thus, strong stresses resulting from deformations of the resilient locking pieces will not act on the front end edge of the surrounding wall. Accordingly, the front end edge of the surrounding wall will not be deformed plastically by the resilient deformations of the resilient locking pieces.

Guides preferably are formed on the wall and the receptacle at opposite sides of the cam pin in directions substantially normal to the moving directions of the terminal protection plate. The guides preferably are substantially parallel to the moving directions of the terminal protection plate. Additionally, the guides preferably are on surfaces of the wall and the receptacle substantially opposite to the wall surface with the locking projections.

The guides stabilize the posture of the male terminal protection plate as the male terminal protection plate is moved, and thus ensure smooth movements. The guides are farther from the cam pins, and thus have a high guiding function. The locking projections also are farther from the cam pins and hence have a high posture stabilizing function. Thus, the guiding function and the posture stabilizing function are more reliable by arranging both the locking projections and the guides at positions distant from the cam pins.

The invention also relates to an assembly comprising the above-described connector and a mating connector connectable therewith. The terminal protection plate is displaced together with the housing of the mating connector and relative to the receptacle by operating an operable member.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
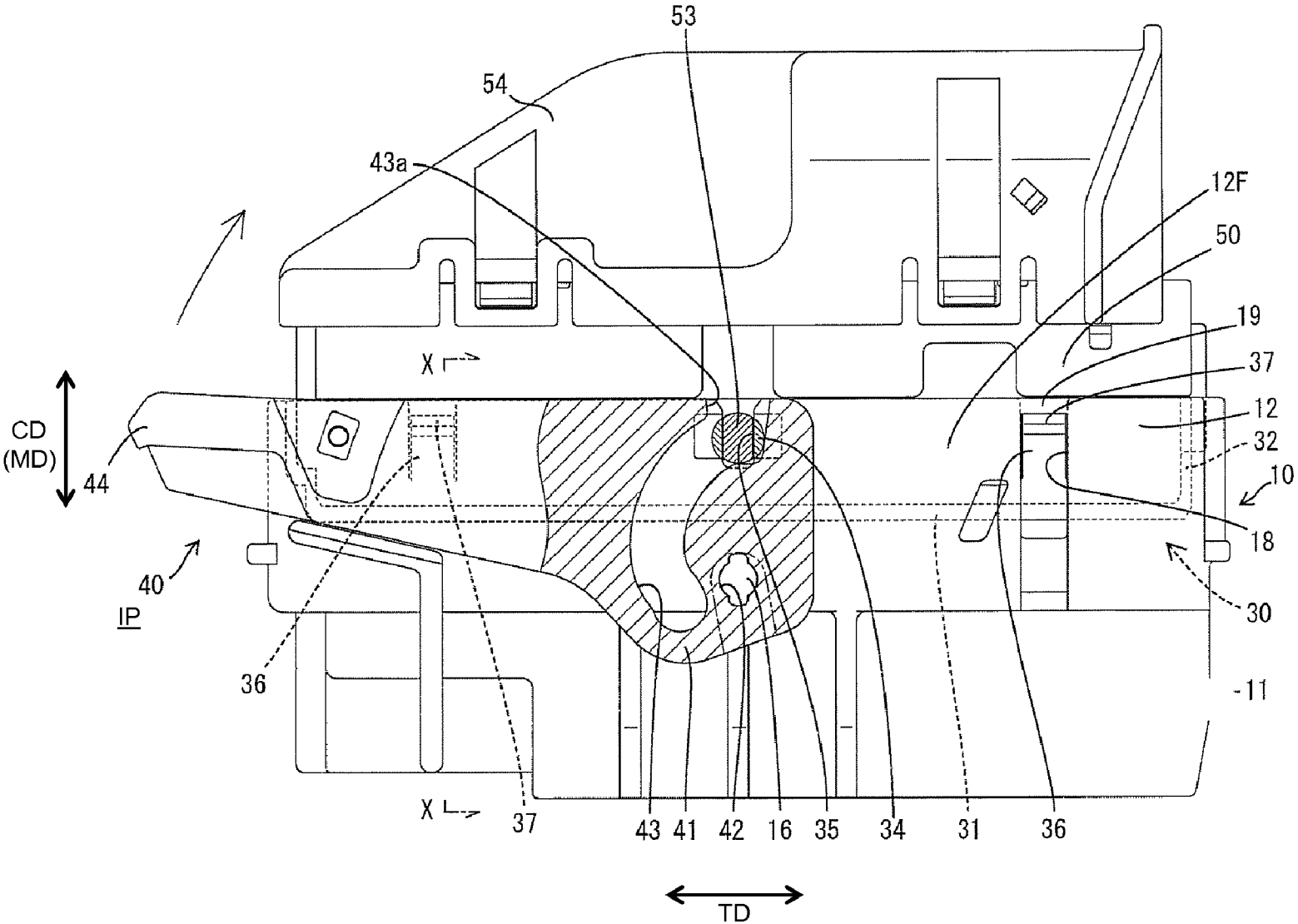
FIG. 1 is a front view partly in section showing a state where a lever is at an initial position in one embodiment.
Figure 2:
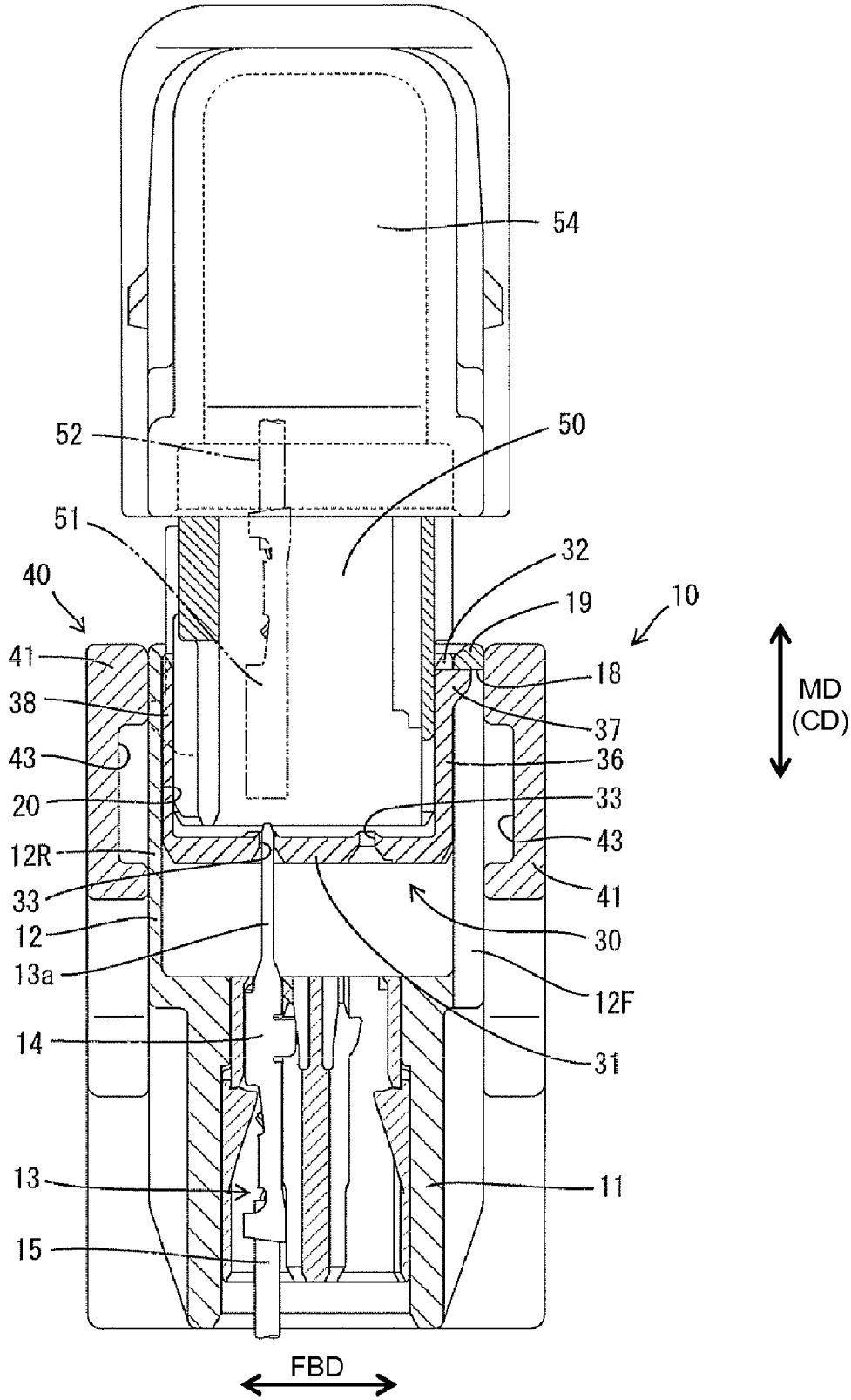
FIG. 2 is a section along X-X of FIG. 1.
Figure 3:
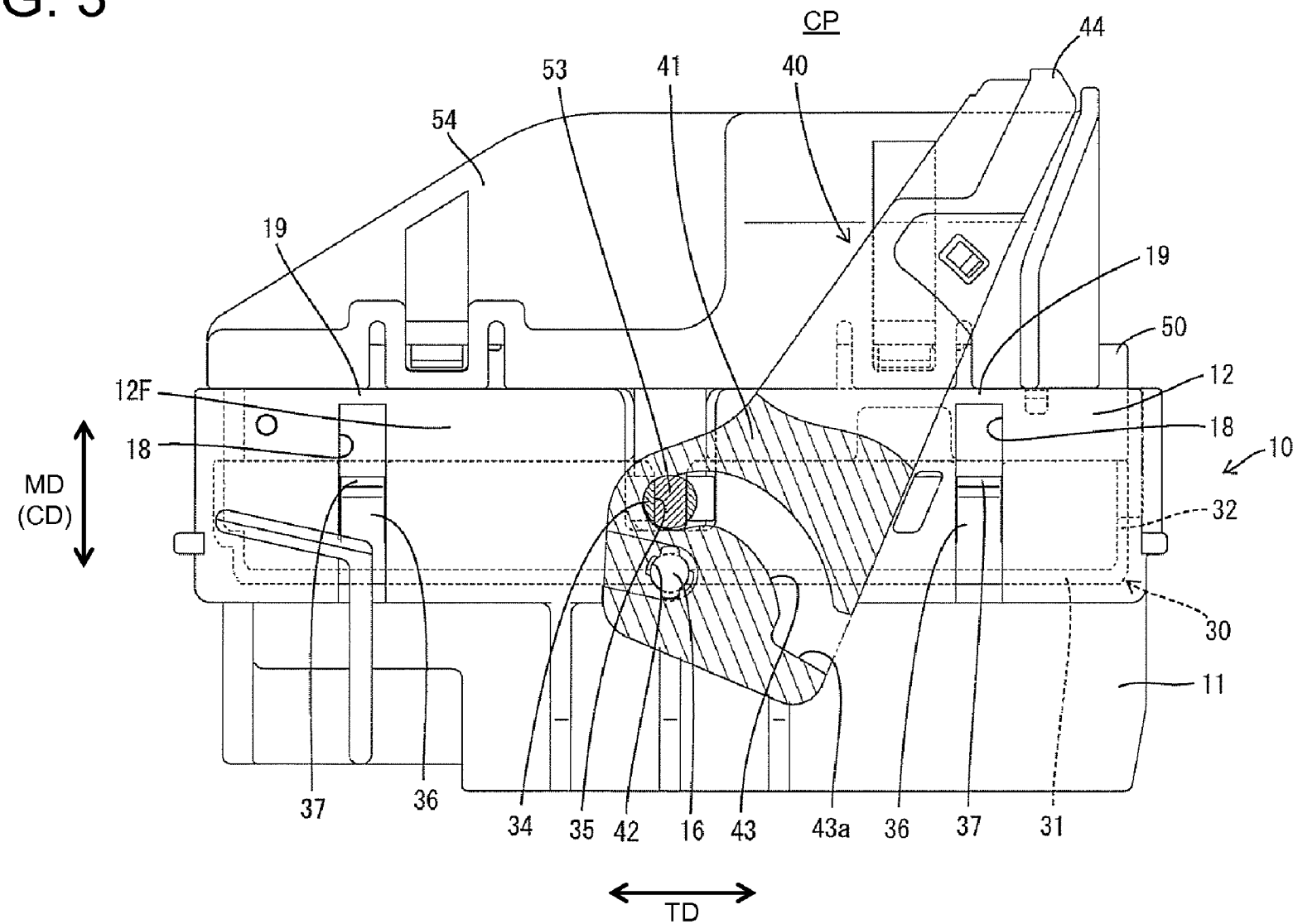
FIG. 3 is a front sectional view section showing a state reached by rotating the lever to a connection position where both male and female housings are connected.
Figure 4:
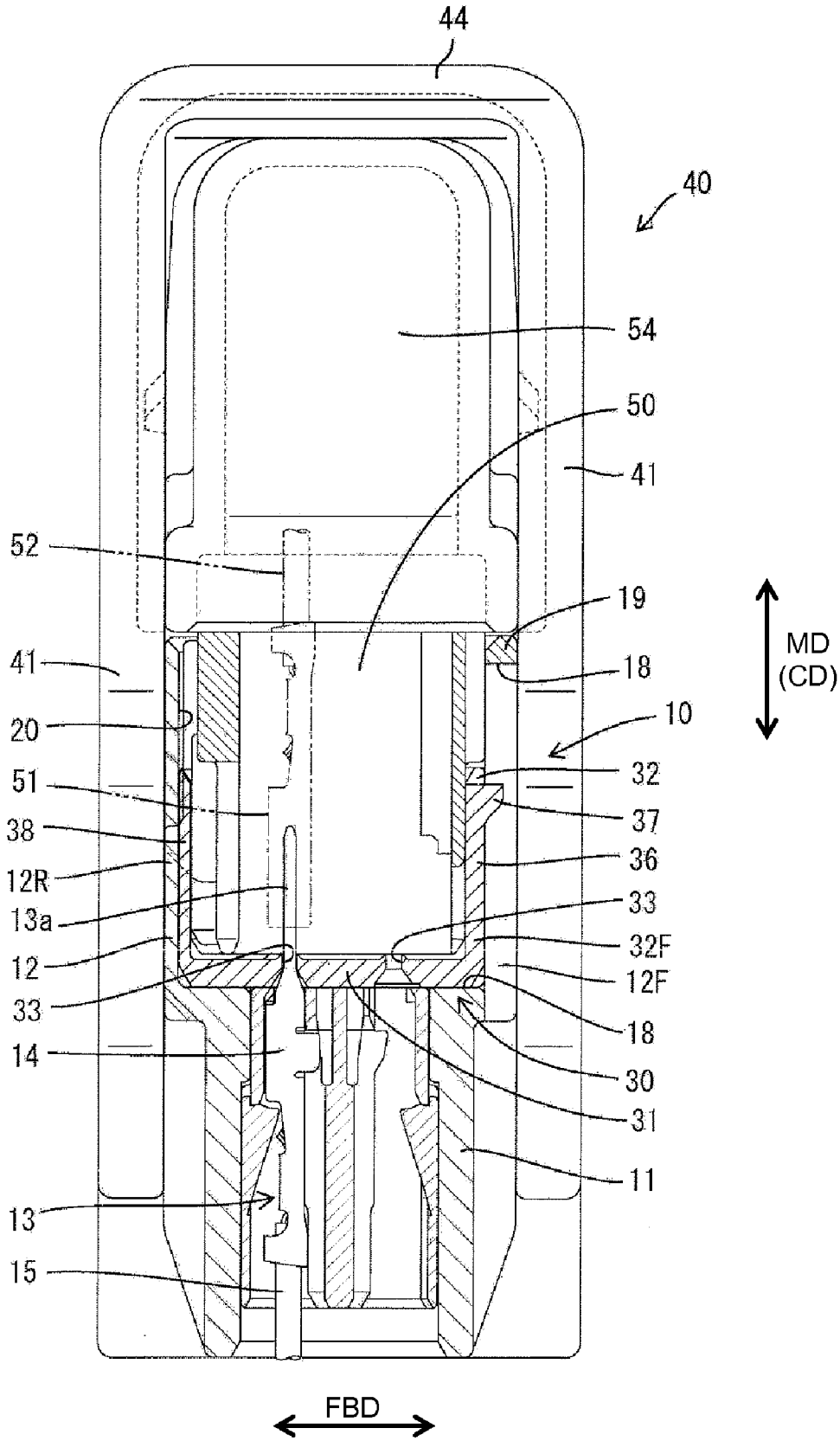
FIG. 4 is a section showing a state where the both housings are connected.
Figure 5:
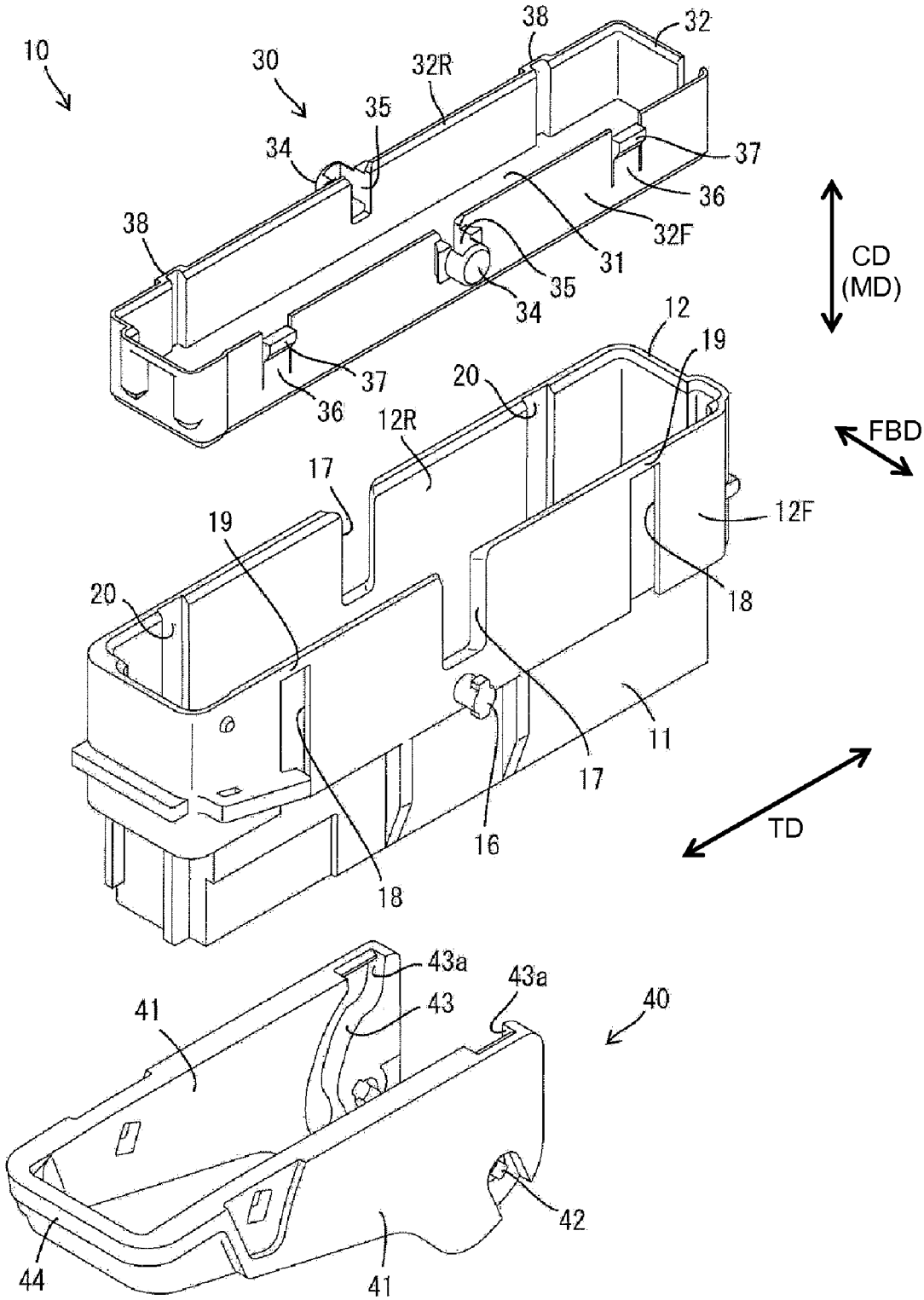
FIG. 5 is a perspective view showing a state where the male housing, a male terminal protection plate and the lever are separated.
Figure 6:
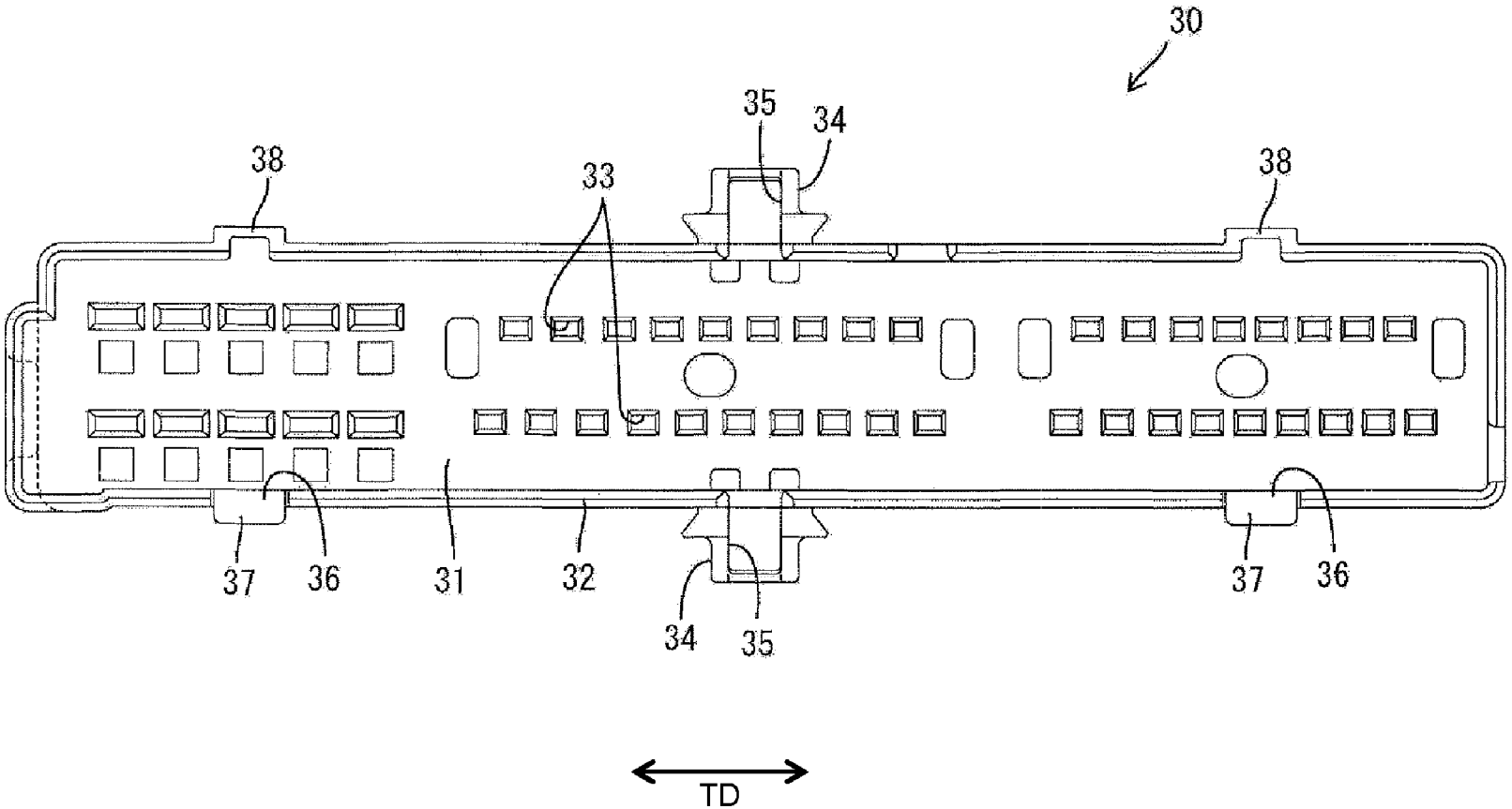
FIG. 6 is a plan view of the male terminal protection plate.
Figure 7:
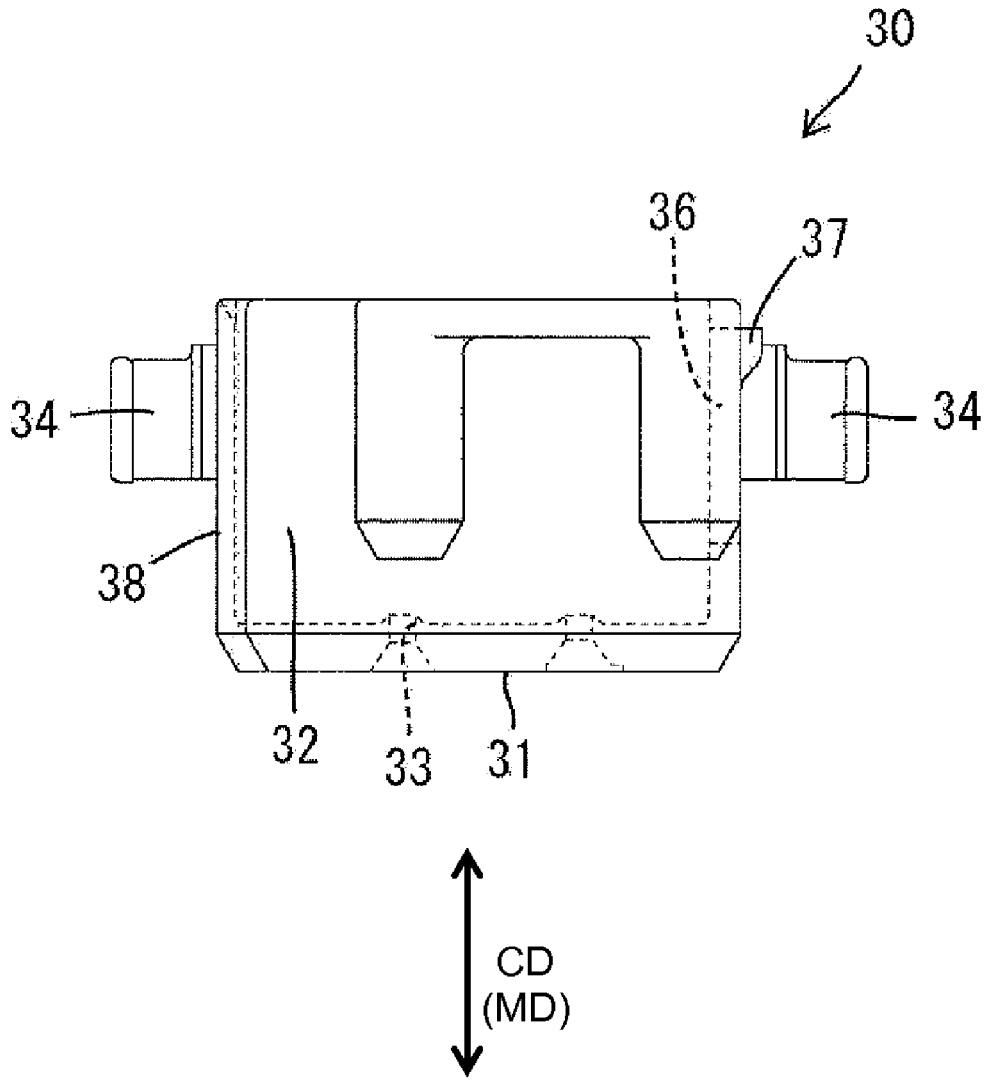
FIG. 7 is a side view of the male terminal protection plate.
Figure 8:
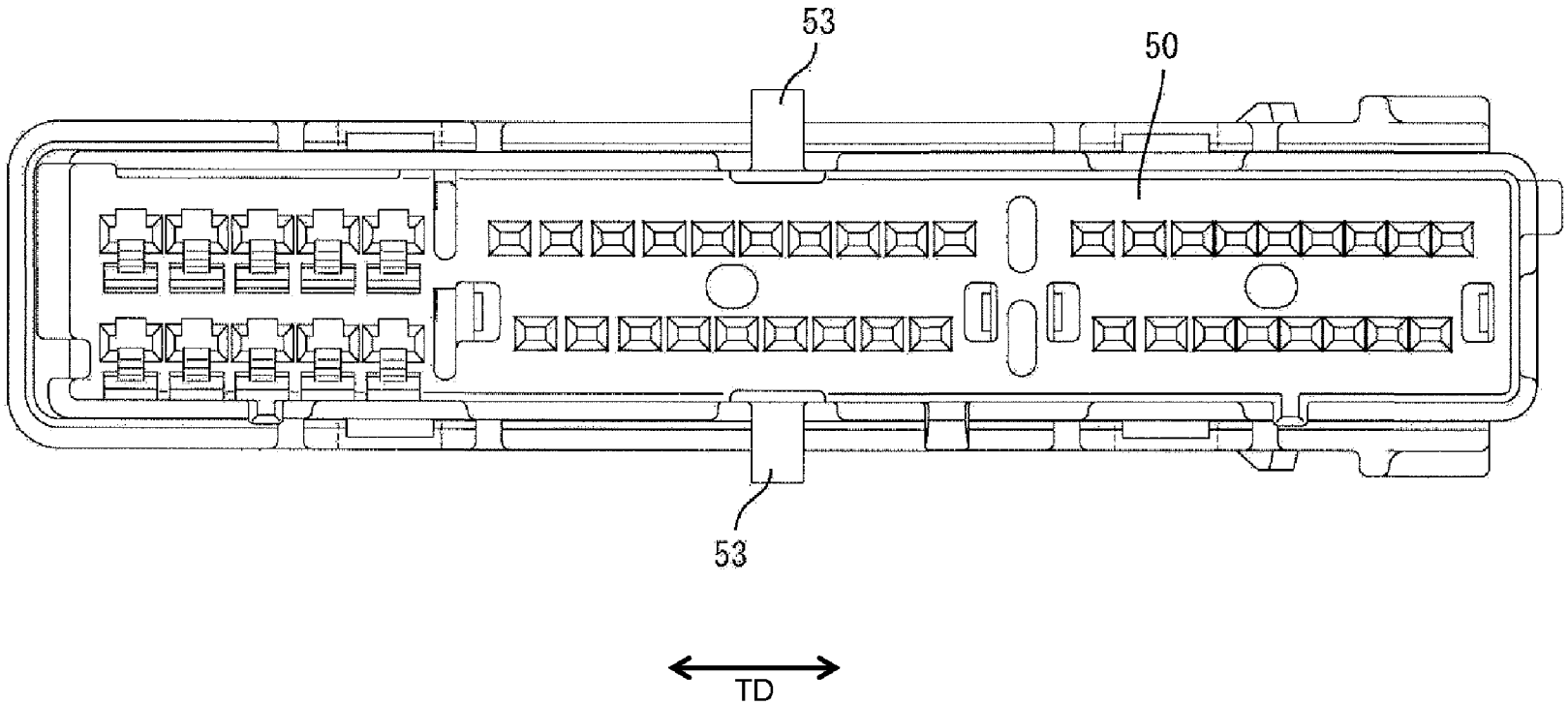
FIG. 8 is a bottom view of the female housing.

A connector in accordance with the invention is illustrated in FIGS. 1 to 9 and includes male and female housings 10 and 50 that are connected and separated along a connecting direction CD. The end of the male housing 10 that faces up in the FIGS. 1 through 5, 7 and 9 is referred to herein as the front end, and defines the end that is connectable with the female housing 50.

The male housing 10 is made e.g. of a synthetic resin and includes a terminal holding portion 11 in the form of a block that is long and narrow in the transverse direction TD. A rectangular tubular receptacle 12 projects up and forward from the peripheral edge of the terminal holding portion 11. Terminal fittings 13 are arranged in the transverse direction TD and have main portions 14 accommodated in the terminal holding portion 11. Each terminal fitting 13 is aligned in forward and backward directions FBD. Wires 15 are secured to the bottom ends of the terminal main bodies 14 and are drawn out from a wire draw out surface at the bottom end of the terminal holding portion 11. Long narrow tabs 13*a* project up and forward from the terminal main bodies 14 and are accommodated in the receptacle 12. The tabs 13*a* are arranged in the transverse direction TD and each tab 13*a* is aligned in forward and backward directions FBD. Supporting shafts 16 project from the outer surfaces of a front plate 12F and a rear plate 12R of the receptacle 12 so that their axial lines extend substantially in forward and backward directions FBD. Escape grooves 17 extend substantially straight down along the connecting direction CD from the upper front end edge of the receptacle 12 towards the supporting shafts 16. The supporting shafts 16 and the escape grooves 17 are arranged substantially in the center of the receptacle 12 with respect to transverse direction TD.

Left and right engaging grooves 18 penetrate the front plate 12F of the receptacle 12 from the inner surface to the outer surface. The engaging grooves 18 are at the opposite left and right sides of the escape grooves 17 and are closer to the opposite left and right edges of the receptacle 12 than to the escape grooves 17 with respect to the transverse direction TD. The engaging grooves 18 extend substantially straight in the vertical direction and have substantially constant widths. Upper end edges of the engaging grooves 18 are near the upper end edge of the receptacle 12 and function as stoppers 19.

Left and right guide grooves 20 are formed in the rear plate 12R of the receptacle 12. The guide grooves 20 are arranged at opposite left and right side of the escape groove 17 and are closer to the opposite left and right edges of the receptacle 12 than to the escape groove 17 with respect to the transverse direction TD. In other words, the guide grooves 20 and the engaging grooves 18 are arranged to substantially correspond to each other in forward and backward directions FBD. The guide grooves 20 are formed by recessing the inner surface of the rear plate 12R and extend straight in the vertical direction, similar to the engaging grooves 18, and the upper ends of the guide grooves 20 open at the upper end edge of the receptacle 12. The guide grooves 20 are formed in the rear plate 12R, which is a wall surface opposite to the front plate 12F formed with the engaging grooves 18 in the receptacle 12.

A male terminal protection plate 30 is accommodated in the receptacle 12 and is made e.g. of a synthetic resin. The male terminal protection plate 30 and has a substantially rectangular plate portion 31 aligned at a substantially right angle to the connecting and separating directions CD of the two housings 10, 50. A substantially rectangular tubular surrounding wall 32 projects up and forward from the peripheral edge of the plate portion 31. Thus, the configuration of the male terminal protection plate 30 substantially conforms to the inner configuration of the receptacle 12 with a tiny clearance defined between the outer peripheral surface of the surrounding wall 32 and the inner peripheral surface of the receptacle 12. The male terminal protection plate 30 is movable substantially vertically along a moving direction MD, which is substantially parallel with connecting and separating directions CD of the two housings 10, 50. Positioning holes 33 are formed in the plate portion 31 for receiving the tabs 13*a* so that the tabs 13*a* remain inserted through the positioning holes 33 at any position of the male terminal protection plate 30 on its moving path. Accordingly, the tabs 13*a* are positioned in directions intersecting the moving direction MD (i.e. the forward and backward directions FBD and the transverse direction TD).

Cam pins 34 are formed on front and rear walls 32F and 32R of the surrounding wall 32 and project substantially normal to the connecting direction CD. The cam pins 34 move in the escape grooves 17 during the movement of the male terminal protection plate 30. Each cam pin 34 is formed with an upwardly open recess 35.

Slits are formed in the front wall 32F to the left and right of the cam pin 34 and extend substantially straight down along the moving direction MD from the upper end of the front wall 32F. The slits define cantilevered resilient locking pieces 36 at opposite sides of the cam pin 34 with respect to the transverse direction TD. The resilient locking pieces 36 align with the engaging grooves 18 of the receptacle 12. Upper extending ends of the resilient locking pieces 36 are exposed at the upper end edge of the surrounding wall 32. A locking projection 37 is formed on the outer surface of the upper end of each resilient locking piece 36. The locking projections 37 are formed over the entire widths of the resilient locking pieces 36 and the widths of the locking projections are substantially equal to or slightly smaller than the widths of the engaging grooves 18. The resilient locking pieces 36 are resiliently deformable while being displaced inward with the bottom ends thereof as supports.

Left and right guide ribs 38 are formed on the rear wall 32R of the surrounding wall 32. The guide ribs 38 project back from the rear wall 32R and extend substantially straight in the moving direction MD. The guide ribs 38 are located to the opposite left and right sides of the cam pin 34 and arranged to correspond to the guide grooves 20 of the receptacle 12. Thus, the guide ribs 38 are on the wall opposite to the wall with the resilient locking pieces 36.

The male terminal protection plate 30 is inserted from above into the receptacle 12 along the moving direction MD. At this time, the left and right resilient locking pieces 36 are deformed sufficiently inward for the locking projections 37 to pass the stoppers 19 and engage with the engaging grooves 18. Thus, the locking projections 37 can move vertically along the moving directions MD of the male terminal protection plate 30 while having movements in directions intersecting the moving direction MD restricted. The cam pins 34 enter the escape grooves 17. Further, the left and right guide ribs 38 engage in the guide grooves 20 of the receptacle 12 and can move vertically, while having transverse movements and inclinations restricted.

The lever 40 is made unitarily of a synthetic resin and has front and rear plate-like arms 41 and an operable portion 44 connecting both arms 41. It should be understood, however, that other operable or movable members such as linear sliders are also within the scope of the invention. Furthermore, the lever may also be provided only with one plate or arm. Each arm 41 is formed with a bearing hole 42. The lever 40 is rotatable between an initial position IP and a connection position CP about the supporting shafts 16 by engaging the bearing holes 42 with the supporting shafts 16. An arcuate or spiraled cam groove 43 substantially centered on the bearing hole 42 is formed in the inner surface of each arm 41, and an entrance 43*a* of the cam groove 43 is oriented to extend out at the peripheral edge of the arm 41.

The entrances 43*a* of the cam grooves 43 align with the upper ends of the escape grooves 17 when the lever 40 is at the initial position IP. Thus, the cam pins 34 enter the entrances 43*a* of the cam grooves 43. The recesses 35 of the cam pins 34 and the entrances 43*a* of the cam grooves 43 face up, as shown in FIG. 1. At this time, the cam pins 34 contact the back end surfaces of the entrances 43*a* of the cam grooves 43 to prevent downward movement of the male terminal protection plate 30 along the connecting direction CD and towards the back side of the receptacle 12. Further, the left and right locking projections 37 contact the corresponding stoppers 19 from below. Thus, an upward movement of the male terminal protection plate 30 also is prevented. In other words, the male terminal protection plate 30 is held by the lever 40 so as not to make any upward or downward movement.

The female housing 50 is made e.g. of a synthetic resin and is substantially in the form of a wide block. Female terminal fittings 51 are arranged in the transverse direction TD in the female housing 50, with each female terminal fitting 51 being aligned in forward and backward directions FBD for connection with the tabs 13*a* of the corresponding male terminal fittings 13. Wires 52 connected with the upper ends of the respective female terminal fittings 51 are drawn out from the upper end of the female housing 50 and are bent laterally by a wire cover 54. Front and rear cam followers 53 project from the front and rear surfaces of the female housing 50. The cam followers 53 are arranged substantially in the center with respect to the width direction, which is substantially normal to the connecting direction CD of the two housings 10, 50, and are engageable with the recesses 35 of the cam pins 34.

Upon connecting the male and female housings 10 and 50, the female housing 50 is fit from above into the male terminal protection plate 30 along the connecting direction CD with the lever 40 at the initial position IP. Thus, the surrounding wall 32 surrounds a bottom end part of the female housing 50. The cam followers 53 then enter the entrances 43*a* of the cam grooves 43 and engage the recesses 35 of the cam pins 34. Thus, the cam pins 34 engage the respective cam grooves 43 while being united with the cam followers 53. The lever 40 then is rotated towards the connection position CP in this state. As a result, the female housing 50 is pulled into the receptacle 12 by a cam action resulting from the engagement of the cam pins 34 and the cam grooves 43 so that the two housings 10, 50 move closer together. At this time, the male terminal protection plate 30 moves down towards the back side of the receptacle 12 together with the female housing 50 and, during the movement of the male terminal protection plate 30, the respective tabs 13*a* are held at proper positions while being inserted through the positioning holes 33. The engagement of the guide grooves 20 and the guide ribs 38 prevent the male terminal protection plate 30 from inclining during the movement into the receptacle 12. The two housings 10, 50 are connected properly when the lever 40 reaches the connection position CP and the tabs 13*a* have entered the female housing 50, as shown FIG. 3, so that the male and female terminal fittings are connected electrically.

The lever 40 is rotated from the connection position CP to the initial position IP to separate the two housings 10, 50. This rotation simultaneously pushes the male terminal protection plate 30 and the female housing 50 up and out relative to the receptacle 12 due to the engagement of the cam pins 34 and the cam grooves 43. The engagement of the guide grooves 20 and the guide ribs 38 ensures that the male terminal protection plate 30 moves relative to the receptacle 12 without inclining. The cam pins 34 move to the entrances 43*a* of the cam grooves 43, as shown in FIG. 1, when the lever 40 reaches the initial position IP, and the cam followers 53 in the recesses 35 can be separated upward. The two housings 10, 50 then can be separated by pulling the female housing 50 apart from the male terminal protection plate 30 while separating the cam followers 53 from the recesses 35.

The left and right locking projections 37 engage the corresponding stoppers 19 from below when the lever 40 reaches the initial position IP and any further upward movement of the male terminal protection plate 30 away from the receptacle 12 is prevented by these two locking actions at the left and right sides. Accordingly, the male terminal protection plate 30 is not separated from the receptacle 12 together with the female housing 50.

Figure 9:
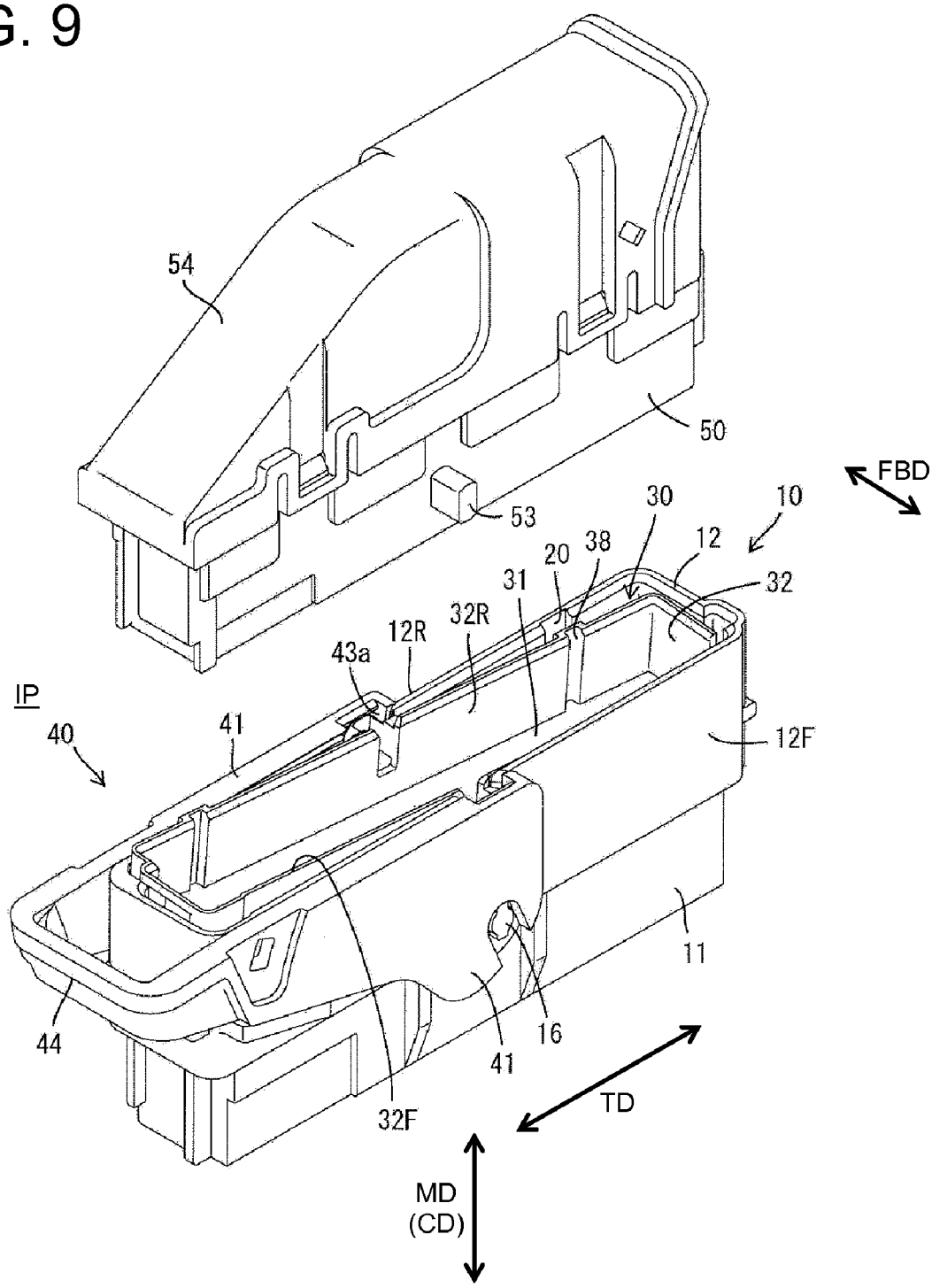
FIG. 9 is a perspective view showing a state where the male terminal protection plate is inclined.

The male terminal protection plate 30 would incline transversely in the receptacle 12 like a seesaw with the cam pins 34 as supports, as shown in FIG. 9, if the connector did not have the locking projections 37, the engaging grooves 18 and the stoppers 19. However, the locking projections 37 and the stoppers 19 engage at two spaced-apart positions at the left and right sides of the cam pin 34. Thus, even if the female housing 50 inclines transversely relative to the receptacle 12 upon separating the female housing 50 from the male terminal protection plate 30, the male terminal protection plate 30 does not incline transversely relative to the receptacle 12. Therefore, there is no mutual interference of the female housing 50 and the receptacle 12 caused by the inclination of the male terminal protection plate 30, and the female housing 50 can be separated smoothly from the male housing 10 without getting caught by the receptacle 12. Thus, overall operability of the connector is improved.

Further, the engagement of the locking projections 37 and the engaging grooves 18 prevents displacements of the male terminal protection plate 30 in the transverse direction TD substantially normal to the moving directions MD of the male terminal protection plate 30 in the moving process of the male terminal protection plate 30 in the receptacle 12. Thus, the male terminal protection plate 30 and the female housing 50 can be moved smoothly in the connecting and separating directions without causing any wrenching movement between the male terminal protection plate 30 and the receptacle 12. In other words, the locking projections 37 function to prevent a seesaw-like inclination of the male terminal protection plate 30 and function to avoid a wrenching movement between the male terminal protection plate 30 and the receptacle 12 during the movement.

Further, the locking projections 37 are formed on the resilient locking pieces 36 that are resiliently displaceable in relative to the surrounding wall 32. Thus, the locking projections 37 can pass the stopper 19 to engage the engaging grooves 18 by resiliently deforming the resilient locking pieces 36 in when the male terminal protection plate 30 is mounted into the receptacle 12.

The extending direction of the resilient locking pieces 36 is the same as the separating direction of the female housing 50 from the receptacle 12, i.e. a direction towards the upper end edge of the surrounding wall 32. Additionally, the extending ends of the resilient locking pieces 36 are exposed at the upper end edge of the surrounding wall 32. Thus, an opening direction of a mold for forming the resilient locking pieces 36 is from the bottom end towards the upper end of the surrounding wall 32, i.e. substantially the same direction as an opening direction of a mold for forming the surrounding wall 32. Accordingly, a mold that opens in a direction normal to the surrounding wall 32 can be eliminated and a cost for the molds can be reduced.

The guide ribs 38 engage the guide grooves 20 to stabilize the posture of the male terminal protection plate 30 to ensure smooth movements of the male terminal protection plate 30. The guide ribs 38 and the guide grooves 20 are more distant from the cam pins 34 and hence have a higher guiding function. The locking projections 37 also are more distant from the cam pins 34 and hence have a higher posture stabilizing function. In this embodiment, the locking projections 37 and the guide ribs 38 and guide grooves 20 are formed on the opposite wall surfaces. Thus, the reliability of both the guiding function and the posture stabilizing function are improved by arranging the locking projections 37, the guide ribs 38 and the guide grooves 20 at positions distant from the cam pins 34.

The invention is not limited to the above described and illustrated embodiment. For example, the following embodiments are also embraced by the technical scope of the present invention as defined by the claims.

According to the invention, the engaging grooves need not make openings in the outer surface of the receptacle.

The locking projections may be fixed so as not to displace relative to the surrounding wall instead of being on the resilient locking pieces.

The resilient locking pieces may be cantilevered at an angle, preferably substantially normal to moving directions of the male terminal protection plate.

The extending direction of the resilient locking pieces may be the substantially same direction as or intersect with the fitting direction of the female housing into the receptacle.

The guiding portions and the locking projections may be arranged on one and other of wall surfaces of the surrounding wall and the receptacle substantially parallel to each other. Rather, the guiding portions and the locking projections may be arranged diagonally.

The surrounding wall may be subdivided into one or more walls being arranged at peripheral positions of the plate. It should be understood, however, that the wall portions need not completely surround the plate.

What is claimed is:

1. A connector comprising:

a housing having a front end and a receptacle extending into the front end, terminal fittings mounted in the housing and having tabs projecting into the receptacle, at least one engaging groove formed at an inner periphery of the receptacle and extending in a moving direction, the engaging groove having a front end in proximity to the front end of the housing, a stopper at the front end of the engaging groove;

an operable member movably mounted on the housing and formed with at least one cam groove; and a terminal protection plate accommodated in the receptacle of the housing and being movable along the moving direction, the terminal protection plate including a plate portion positions the tabs of terminal fittings and at least one wall at an outer peripheral area of the plate portion, at least one cam pin projecting from the wall and being engageable with the cam groove, at least one locking projection projecting out from an outer peripheral surface of the wall and being engageable with the stopper of the engaging groove prevents the separation of the terminal protection plate from the receptacle.

2. The connector of claim 1, wherein the at least one engaging groove comprises two engaging grooves offset at opposite sides of the cam pin in directions substantially normal to the moving direction.

3. The connector of claim 2, wherein the at least one locking projection comprises two locking projections disposed for engaging the engaging grooves.

4. The connector of claim 3, wherein the locking projections are formed on resilient locking pieces displaceable inward relative to the wall.

5. The connector of claim 4, wherein the resilient locking pieces are cantilevered substantially in the moving direction.

6. The connector of claim 5, wherein the extending ends of the locking projections are exposed at a front end edge of the wall.

7. The connector of claim 1, wherein guides are formed on the wall and the receptacle at positions offset from the cam pin in directions substantially normal to the moving direction, the guides being substantially parallel to the moving direction.

8. The connector of claim 7, wherein the guides are arranged on surfaces of the wall and the receptacle substantially opposite to a surface formed with the locking projections.

9. A connector assembly comprising:

a housing having a front end and a receptacle extending into the front end, terminal fittings mounted in the housing and having tabs projecting into the receptacle, at least one engaging groove formed at an inner periphery of the receptacle and extending in a moving direction, the engaging groove having a front end in proximity to the front end of the housing, a stopper at the front end of the engaging groove;

an operable member movably mounted on the housing and formed with at least one cam groove;

a terminal protection plate accommodated in the receptacle of the housing and being movable along the moving direction, the terminal protection plate including a plate portion positions the tabs of terminal fittings and at least one wall at an outer peripheral area of the plate portion, at least one cam pin projecting from the wall and being engageable with the cam groove, at least one locking projection at an outer peripheral surface of the wall and being engageable with the stopper of the engaging groove for preventing the separation of the terminal protection plate from the receptacle; and a mating housing displaceable with the terminal protection plate and relative to the receptacle by operation of the operable member.

10. The connector assembly of claim 9, wherein the mating housing has at least one cam follower uniteable with the cam pin of the terminal protection plate and engageable with the cam groove of the operable member.

* * * * *